US006305567B1

(12) United States Patent
Sulpizio

(10) Patent No.: US 6,305,567 B1
(45) Date of Patent: Oct. 23, 2001

(54) DRAWER INSERT

(76) Inventor: Alfred Sulpizio, 1206 Waverly Walk, Philadelphia, PA (US) 19147

( * ) Notice: Subject to any disclaimer, the term of this patent is extended or adjusted under 35 U.S.C. 154(b) by 0 days.

(21) Appl. No.: 09/585,040

(22) Filed: Jun. 1, 2000

Related U.S. Application Data

(60) Provisional application No. 60/137,392, filed on Jun. 3, 1999.

(51) Int. Cl.[7] ..... B65D 25/00

(52) U.S. Cl. ..... 220/495.11; 220/495.01; 220/8; 220/9.4

(58) Field of Search ..... 220/495.11, 495.08, 220/495.02, 495.01, 8, 9.2, 9.3, 9.4, 23.9

(56) References Cited

U.S. PATENT DOCUMENTS

| | | | | |
|---|---|---|---|---|
| 2,801,766 | * | 8/1957 | Bishop et al. | 220/495.01 X |
| 2,907,487 | * | 10/1959 | Harrington | 220/8 |
| 3,233,816 | * | 2/1966 | Cherrin | 220/495.01 |
| 4,120,417 | * | 10/1978 | Aquino | 220/9.4 X |
| 5,411,165 | * | 5/1995 | Ellis | 220/495.08 |
| 5,887,961 | * | 3/1999 | Rosenberg et al. | 220/8 X |
| 6,073,794 | * | 6/2000 | Bidot | 220/8 X |

* cited by examiner

*Primary Examiner*—Steven Pollard
(74) *Attorney, Agent, or Firm*—Akin, Gump, Strauss, Hauer & Feld, L.L.P.

(57) ABSTRACT

A protective insert for a drawer having a plurality of sidewalls which are interconnected by a bottom wall is comprised of a generally continuous, generally tubular frame. The frame is formed of a plurality of interconnected, generally flat panels, the number of panels corresponding to the number of sidewalls of the drawer. Each of the frame panels is sized and shaped to conform to and to engage and cover at least a portion of an interior surface of the sidewalls of a corresponding one of the drawer. A flexible liner extends between each of the panels of the frame to engage and cover at least a substantial portion of the bottom wall of the drawer. In this manner, the frame retains the liner in place within the drawer such that the combination of the liner and the frame cover and protect at least a substantial portion of the interior surfaces of the drawer. In one embodiment, the frame is adjustable to fit drawers of different sizes and the liner is a sheet of polymeric material. In another embodiment, the frame is a predetermined, fixed size and the liner is a polymeric bag, which is secured to the frame.

4 Claims, 5 Drawing Sheets

FIG. 6
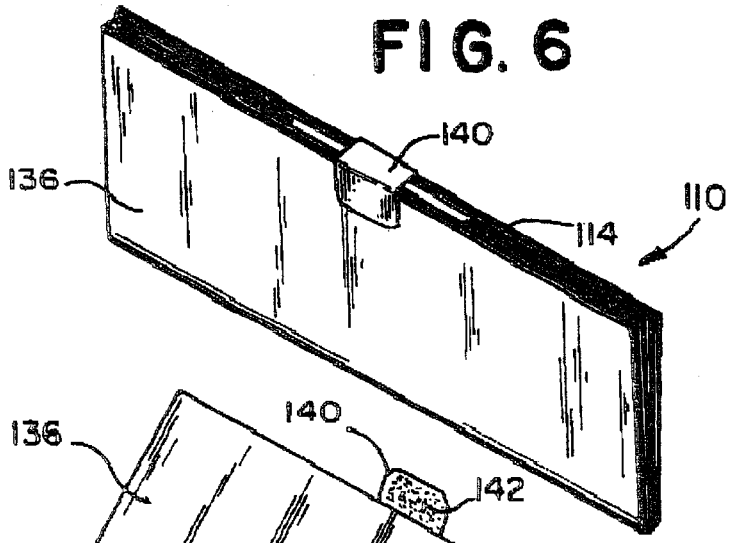
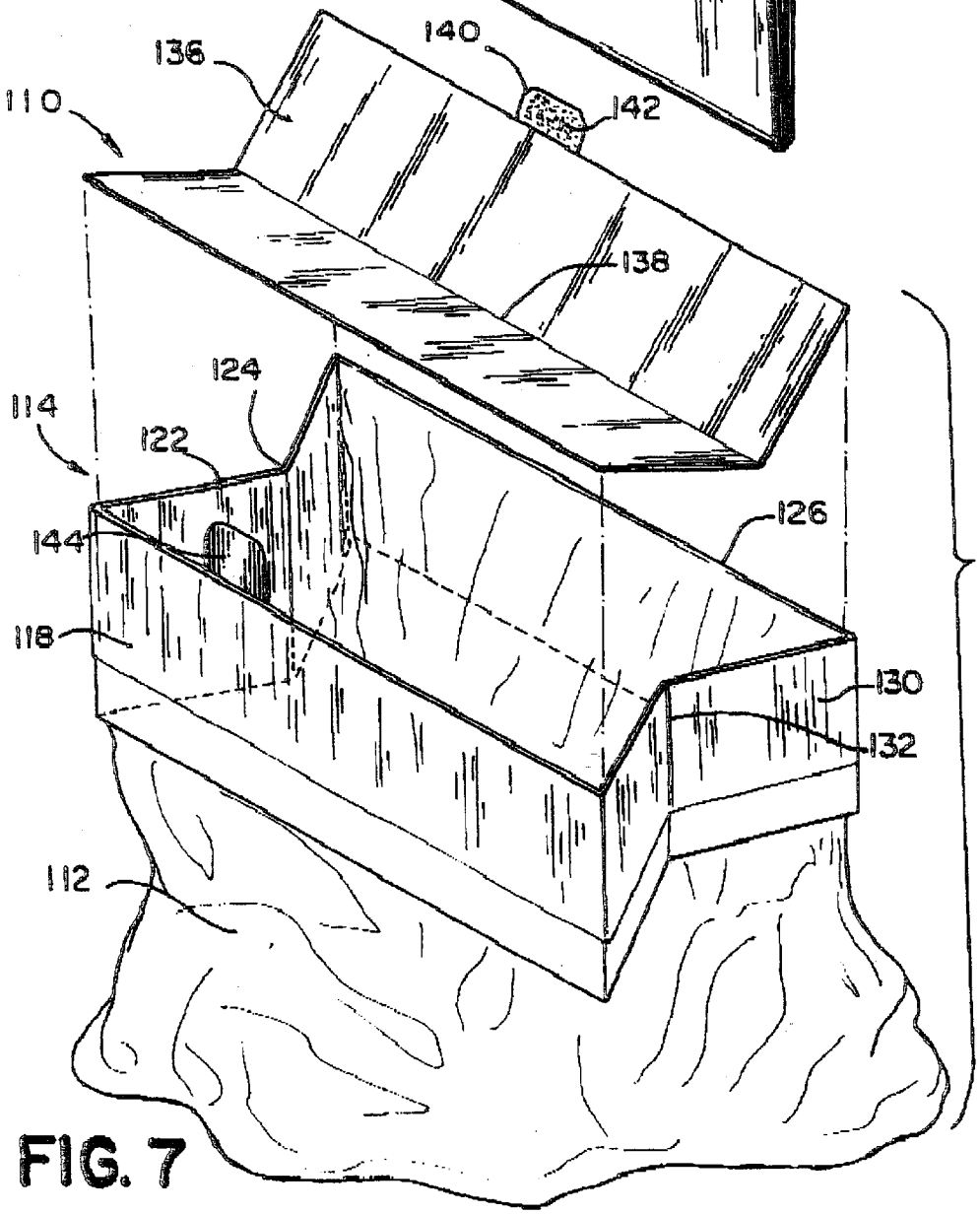
FIG. 7

DRAWER INSERT

CROSS REFERENCE TO RELATED APPLICATIONS

This application claims the priority of U.S. Provisional Patent No. 60/137,392 filed Jun. 3, 1999 and entitled "Drawer Insert".

BACKGROUND OF THE INVENTION

The present invention relates to an insert for a drawer-shaped container and, more specifically, to a drawer insert that can be used with either a re-usable or disposable liner.

There are many instances when the lack of a drawer liner results in the annoying loss of time and a need to creatively find something that can be used as a liner. For example, one source of aggravation is having to clean the crisper drawer in a refrigerator. While crisper drawers are ideal for the storage of fruits and vegetables, fruits and vegetables are often kept in the crisper drawer beyond the point of freshness. When the fruits and vegetables start to spoil, liquids tend to secrete, and/or spoiled or rotten fruit or vegetable pieces accumulate as debris in the bottom of the crisper. Left uncleaned, such debris can result in strong odors that can spread throughout the refrigerator, and left unchecked, can even foul the air in the kitchen. Unfortunately, the location of the crisper drawer often makes it difficult to remove the crisper drawer in order to properly remove and clean such debris from the drawer. The cleaning of a crisper drawer is made more unpleasant still, by corrugations and other drawer features often formed in the bottom of the crisper, into which the debris may flow and harden. Such corrugations necessitate a lengthy and meticulous cleaning job in order to remove the debris and to prevent further fowling of the air, both in the refrigerator and in the kitchen.

Another example of a need for a drawer insert occurs when it is necessary to temporarily use a less than clean dresser to store clean clothes. For instance, hotel dresser drawers are often dirty, or otherwise soiled, making it undesirable to put clean clothes into the dresser drawers, which is a necessity when a traveler is staying in the hotel for an extended length of time. Finding a way to conveniently line the drawers, so as to prevent the soiling of one's clothing, can be a time-consuming and aggravating process.

Drawer inserts are useful in many situations other than those in which the drawer insert is placed in a drawer-shaped container. For example, when coming in from the rain, finding a place to put wet shoes within the home can be difficult. While it would be simple to put the shoes away in a closet, it is advantageous for the shoes to be left out to facilitate drying. However, depending on the type of floor or carpeting in one's home, leaving shoes out in an area convenient for drying can cause damage to the floor or carpeting.

Drawer-type inserts can also be useful when traveling in an automobile. Sometimes when going camping, or otherwise exercising outdoors, dirty or wet gear has to be placed in the trunk of a car. This can be disconcerting when a car has been maintained in a relatively clean condition. While it is possible to carry containers into which the gear can be placed, the storage of the containers, while not being used, can present a problem for homeowners and apartment dwellers alike.

In a similar vein, the repotting of plants in one's home can result in soil, and associated grime, being strewn about. While it is possible to find a container for use during the repotting process, the homeowner or apartment dweller is then left with having to clean and store the used container.

The present invention provides a drawer insert that overcomes the variety of difficulties and problems described above. The drawer insert of the present invention can be placed inside of a crisper drawer in a refrigerator to prevent the collecting of debris in the bottom of the crisper drawer. Once it is necessary to remove debris, the liner can simply be removed for either cleaning or replacement.

The drawer insert of the present invention can be collapsed for easy transportation for convenient use in a hotel or motel dresser drawer, or for use in the trunk of a car. The adjustable frame and liner can fit in the side pocket of a suitcase to provide a convenient method for lining a dirty or soiled dresser drawer. Alternatively, the adjustable frame and liner can be placed in a tire well for convenient removal and use when wet or dirty gear is to be transported in a trunk.

Furthermore, the drawer insert of the present invention is not limited to use in drawers or drawer-shaped containers. The adjustable frame and liner can be used in combination with a supporting surface to provide a convenient drop cloth for use in repotting plants and other messy activities.

BRIEF SUMMARY OF THE INVENTION

Briefly stated, the present invention comprises a protective insert for a drawer having a plurality of sidewalls which are interconnected by a bottom wall. The insert comprises a generally continuous, generally tubular frame formed of a plurality of interconnected, generally flat panels. The number of panels of the frame correspond to the number of sidewalls of the drawer with each of the frame panels being sized and shaped to conform to and to engage and cover at least a portion of an interior surface of a corresponding one of the sidewalls of the drawer. A flexible liner extends between each of the panels of the frame to engage and cover at least a substantial portion of the bottom wall of the drawer. The frame thereby retains the liner in place within the drawer such that the combination of the liner and the frame cover and protect at least a substantial portion of the interior surfaces of the drawer. In one embodiment, the frame is adjustable to fit drawers of different sizes and the liner is comprised of a sheet of polymeric material installed over the frame panels. In another embodiment, the frame is of a predetermined size and the liner is comprised of a bag secured to the frame.

BRIEF DESCRIPTION OF THE SEVERAL VIEWS OF THE DRAWINGS

The foregoing summary, as well as the following detailed description of preferred embodiments of the present invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 6 is a perspective view of a second preferred embodiment of a drawer insert in accordance with the present invention as initially packaged;

FIG. 7 is an exploded perspective view of the drawer insert of FIG. 6;

DETAILED DESCRIPTION OF THE INVENTION

Figure 1:
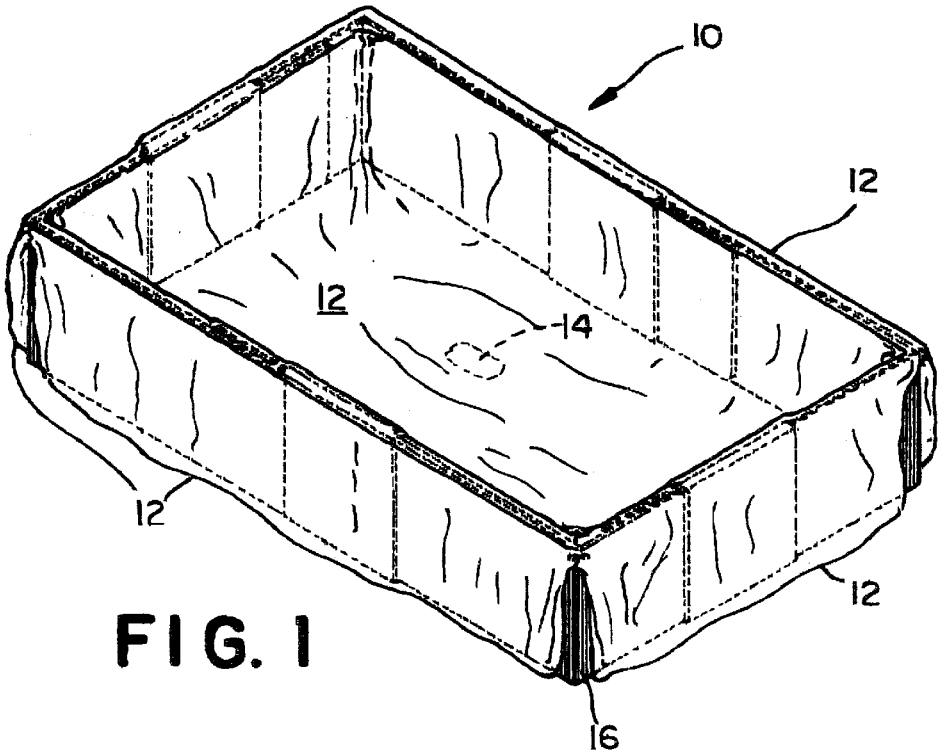
FIG. 1 is a perspective view of a drawer insert, according to a first preferred embodiment of the present invention.

In the drawings, like numerals are used to indicate like elements throughout the several figures. Certain terminology is used in the following description for convenience only, and is not limiting. The words "right," "left," "lower," and "upper" designate directions in the drawings to which reference is made. The words "inwardly" and "outwardly" refer to directions toward and away from, respectively, the geometric center of the drawer insert and designated parts thereof The terminology includes the words above specifically mentioned, derivatives thereof and words of similar import.

Referring to FIGS. 1–5, a first preferred embodiment of a drawer insert according to a preferred embodiment of the present invention, is generally designated 10. The drawer insert 10 has an adjustable frame structure that allows the drawer insert 10 to easily fit into a drawer or drawer-shaped container or to be used as a stand-alone container that functions similarly to a drop cloth. The drawer insert 10 uses a flexible liner 12 in combination with an adjustable, generally tubular frame 16 so that it is compatible with a wide variety of drawer-shaped containers. Generally speaking, the drawer insert 10 is constructed using a liner 12, which may be disposable, that is tucked around and captured between the outer surfaces of the adjustable frame 16 and the sidewalls of a drawer to form a protective insert that can easily fit into drawers of various sizes. The adjustable frame 16 is preferably constructed of a plurality of generally L-shaped panels that are described in detail below. In the illustrated embodiment there are four L-shaped panels which are slidably interconnected so that the resulting adjustable frame 16 can have either its length or its width or both adjusted to fit a particular drawer, as also described in detail below.

Figure 2:
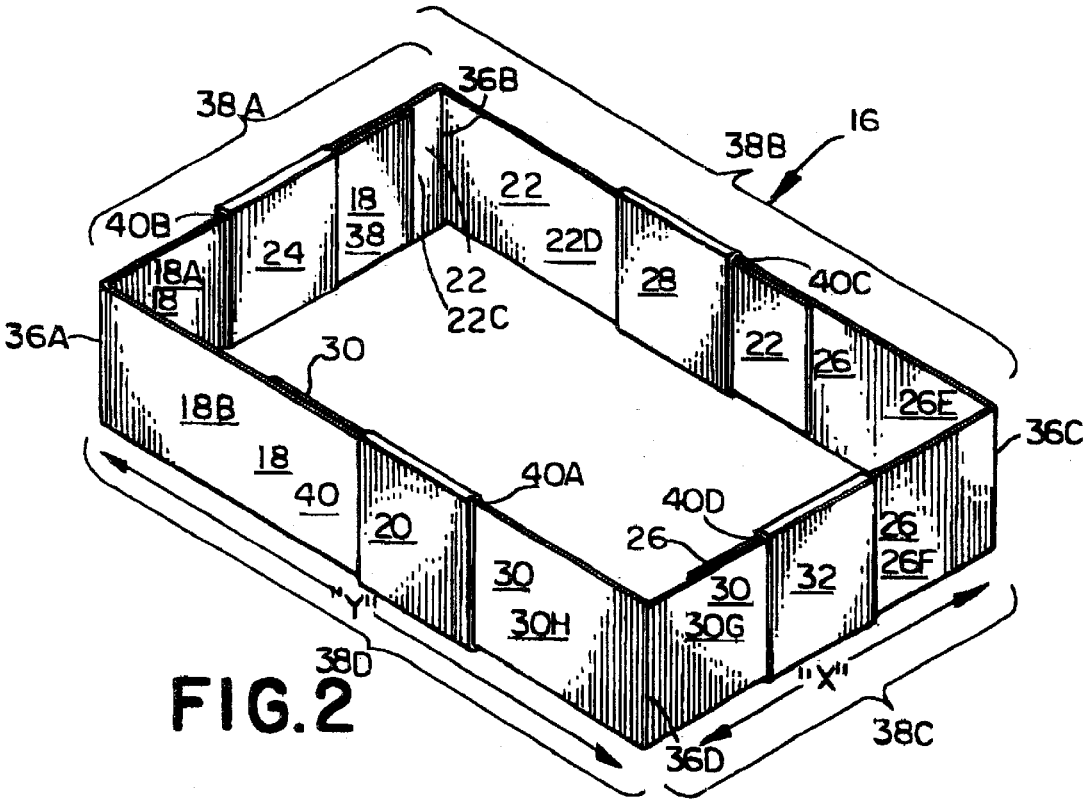
FIG. 2 is a perspective view of an adjustable frame of the drawer insert of FIG. 1 substantially adjusted to exhibit close to its maximum, or most expanded, length and width.
Figure 3:
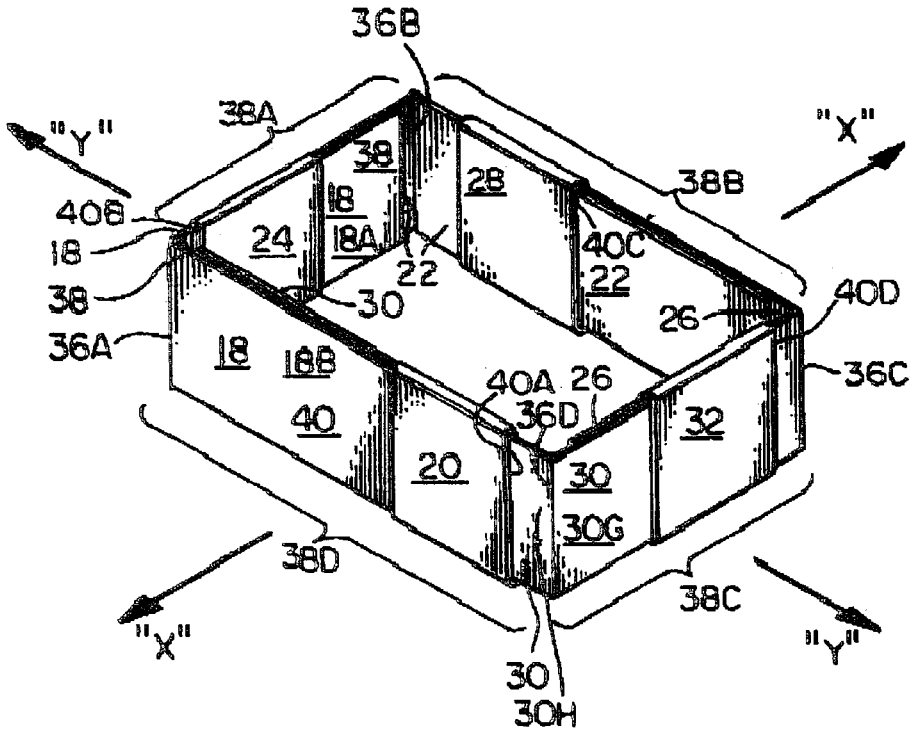
FIG. 3 is a perspective view of the adjustable frame of the drawer insert of FIG. 1 substantially adjusted to exhibit its smallest, or most retracted, length and width.

Referring now to FIGS. 2 and 3, the adjustable frame 16 is formed of a plurality, preferably four generally L-shaped, generally flat panel members or panels 18, 22, 26, 30 that are interconnected to form a generally tubular, rectangularly shaped frame 16. The number of panel members depends upon the number of sidewalls of the drawer with which the insert 10 is to be used. The four L-shaped panels 18, 22, 26, 30 each have a similar structure and are sized and shaped to conform to and engage and cover at least a portion of an interior surface of each of the sidewalls of the drawer. Accordingly, only the first L-shaped panel 18 will be described in detail (the second, third and fourth L-shaped panels 22, 26, 30 being substantially similar to the first L-shaped panel 18).

The first L-shaped panel 18 is preferably formed of a single rectangular member that is folded about a first fold line 36A to form first and second subpanels 18A, 18B that are disposed generally at right angles to each other in a substantially L-shaped configuration. While the first and second subpanels 18A, 18B are preferably identical in size and each have a rectangular shape, it should be understood by those of skill in the art that the present invention is not limited to the particular shape or relative size of the first and second subpanels 18A, 18B of the first L-shaped panel 18 nor is the present invention limited to both the first and second subpanels 18A, 18B having the same size or shape. For instance, the first subpanel 18A can have a substantially square shape while the second subpanel 18B can have a substantially rectangular shape if desired.

A first sleeve 20 is attached to the outer face of the second subpanel 18B proximate to the distal end of the second subpanel 18B that is opposite from the first fold line 36A. The first sleeve 20 extends from the top edge of the second subpanel 18B to the bottom edge of the second subpanel 18B. The first sleeve 20 is preferably affixed, using an adhesive, to the second subpanel 18B. The first sleeve 20 has a bow-shaped configuration along the inner face of the second subpanel 18B that causes the first sleeve 20 to be bent inwards towards the center of the adjustable frame 16. Thus, the first sleeve 20 forms a first chute 40A between the inner face of the second subpanel 18B and the first sleeve 20.

The second subpanel 18B is preferably constructed with slight recesses (not shown) along the top and bottom edges of the second subpanel 18B into which portions of the first sleeve 20 are inserted. The recesses (not shown) prevent the first sleeve from tilting the first L-shaped panel 18 towards the first fold line 36A due to the bottom portion of the first sleeve 20 extending downwardly below the lower edge of the second subpanel 18B.

To form half of the adjustable frame 16, the first L-shaped panel 18 is slidably engaged with a second L-shaped panel 22. The second L-shaped panel 22 is comprised of a generally rectangularly shaped member that is angled along a second fold line 36B to form a third and a fourth subpanel 22C, 22D that each have a generally rectangular shape. The third subpanel 22C has a second sleeve 24 attached along an outer face proximate to an end opposite from the second fold line 36B. The second sleeve 24 is attached to the third subpanel 22C in a fashion similar to that described with respect to the first sleeve 20, thereby creating a second chute 40B between the inner face of the third subpanel 22C and the second sleeve 24. The first subpanel 18A of the first L-shaped panel 18 is slidably inserted into the chute that is formed between the second sleeve 24 and the third subpanel 22C of the second L-shaped panel 22. By adjusting the amount of the first subpanel 18A of the first L-shaped panel 18 that is inserted through the second chute 40B, the length of the first side 38A can be adjusted along a direction parallel to the axis denoted "X." Accordingly, the first L-shaped panel 18 and the second L-shaped panel 22 combine to form a substantially U-shaped member that is adjustable along a direction parallel to the "X" axis. FIG. 2 illustrates the first L-shaped panel 18 and the second L-shaped panel 22 in a substantially fully-expanded position. Referring to FIG. 3, the first side 38A can be reduced in length until the edge of the first subpanel that is opposite from the first fold line 36A contacts the fourth subpanel 22D of the second L-shaped panel 22. The adjustable frame 16 shown in FIG. 3 is substantially adjusted to use a minimum width and length.

The third and fourth L-shaped panels 26, 30 are attached to each other in a fashion similar to that described with reference to the first and second L-shaped panels 18, 22. The seventh subpanel 30G, which forms part of the fourth L-shaped panel 30, has a fourth sleeve 32 attached on an outer surface proximate to an end opposite to the fourth fold line 36D. The sixth subpanel 26F which forms a part of the third L-shaped panel 26 is inserted in a fourth chute 40D that is formed between the inner face of the seventh subpanel 30G and the fourth sleeve 32. Thus, the third and fourth L-shaped panels 26, 30 are slidably adjustable with respect to each other along a direction parallel to the "X" axis.

The third L-shaped panel 26 bears a third sleeve 28 on the outer face of a fifth subpanel 26E. The third sleeve 28 is attached proximate to an end of the fifth subpanel 26E that is opposite from the third fold line 36C. The third sleeve 28 forms a third chute 40C between the inner face of the fifth subpanel 26E and the third sleeve 28. The use of the third sleeve 28 is described below.

To join the first and second L-shaped panels 18, 22 with the third and fourth L-shaped panels 26 and 30, the respective pairs (as described above) are adjusted so that the first side 38A and the third side 38C of the adjustable frame 16 are generally identical. Then, the fourth subpanel 22D is inserted through the third chute 40C formed by the third sleeve 28 and the fifth subpanel 26E of the third L-shaped panel 26. At the same time, the eighth subpanel 30H of the fourth L-shaped panel 30 is inserted through the first chute 40A formed by the first sleeve 20 and the inner face of the second subpanel 18B of the first L-shaped panel 18. Once the first and second L-shaped panels 18,22 are slidably engaged with the fourth and the third L-shaped panels 30, 26, respectively, the adjustable frame 16 is adjustable along a direction parallel to the "Y" axis, thereby allowing the length of the second and third sides 38B, 38D of the adjustable frame 16 to be adjusted.

Once the four L-shaped panels 38A–38D of the adjustable frame 16 are positioned to have the desired dimensions, clips or fasteners (not shown) are attached or inserted through the appropriate panels to secure the adjustable frame 16 into a generally rectangular shape having the desired dimensions. For example, binder clips, Velcro, or an adhesive can be used to secure the four L-shaped panels 38A–38D into position.

While in the present embodiment the four L-shaped panels 18, 22, 26, 30 are formed of an inexpensive, durable, and flexible material, such as cardboard or a polymer, it is understood by those of skill in the art from this disclosure that the present invention is not limited to the type of material used to form the four L-shaped panels 18, 22, 26, 30. For instance, the adjustable frame may be constructed using a foam-type material, a Styrofoam®-type material, or an aluminum or other metal material or the like. While some of the above-mentioned materials are not flexible enough to be easily folded along an arbitrary fold line 36A–36D, the various panels can be preformed along a fold line or can be attached by either a hinge or clip mechanism, as appropriate.

While the four L-shaped panels 18, 22, 26, 30 are preferably formed of panels joined to form a ninety degree angle, it should be understood from this disclosure by those of skill in the art, that the L-shaped panels 18, 22, 26, 30 are not limited to panels that are integrally formed or that are joined to form a ninety degree angle. For instance, the various panels can be joined to form any of a fifteen degree, thirty degree, forty-five degree, sixty degree, seventy-five degree, and an eighty-five degree angle, etc. While many drawer-shaped containers, such as the crisper drawer 34 shown in FIG. 5, have a rectangular shape, some drawers, due to manufacturing error or design, have a non-rectangular shape. Accordingly, the angles between the respective subpanels of each of the L-shaped panels 18, 22, 26, 30 can be adjusted to allow the adjustable frame 16 to properly sit inside of variously shaped drawer-type containers.

The height of the adjustable frame 16 is preferably equal to or slightly less than the depth of the drawer-shaped container in which it is fitted. However, those of skill in the art will understand through this disclosure that the height of the drawer insert 10 can be designed to be taller or shorter than the drawer-shaped container.

While the sleeves 20, 24, 28, 32 are preferably adhesively attached to the appropriate subpanels of the adjustable frame 16, it should be understood from this disclosure that the first through fourth sleeves 20, 24, 28, 32 can be integrally formed or molded through a suitable molding or casting process with their respective L-shaped panels. Furthermore, while the first through fourth L-shaped panels 18, 22, 26, 30 are shown as having substantially identical dimensions, it should be understood through this disclosure by those of skill in the art that the various L-shaped panels 18, 22, 26, 30 can vary in length or height. Thus, an adjustable frame 16 can be designed for use in drawer-shaped containers having a dimension along the "Y" axis that is substantially greater than the dimension along the "X" axis of the drawer-shaped container. Furthermore, it may be desirable in some situations to use an adjustable frame 16 that has varying-sized heights for the different L-shaped panels 18, 22, 26, 30.

Figure 4:
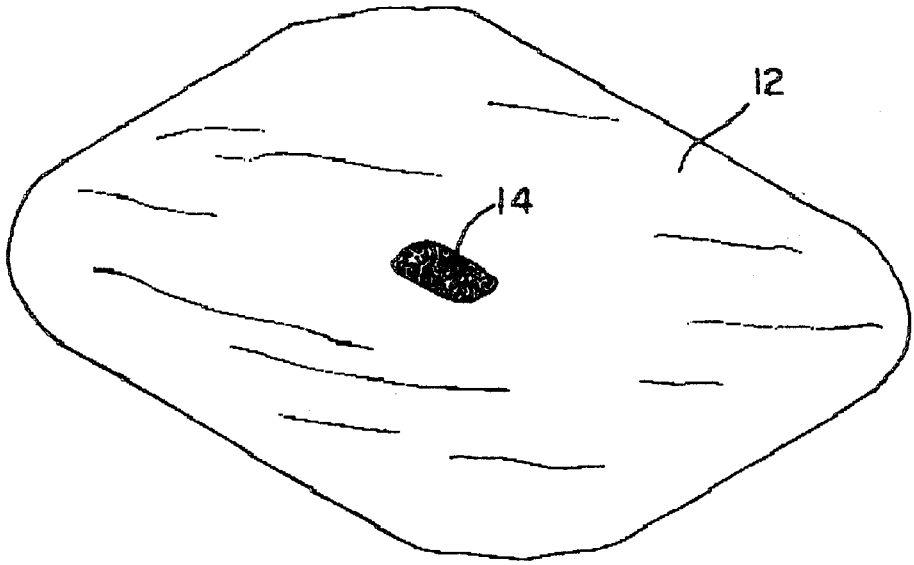
FIG. 4 is a perspective view of the liner portion of the drawer insert of FIG. 1.
Figure 5:
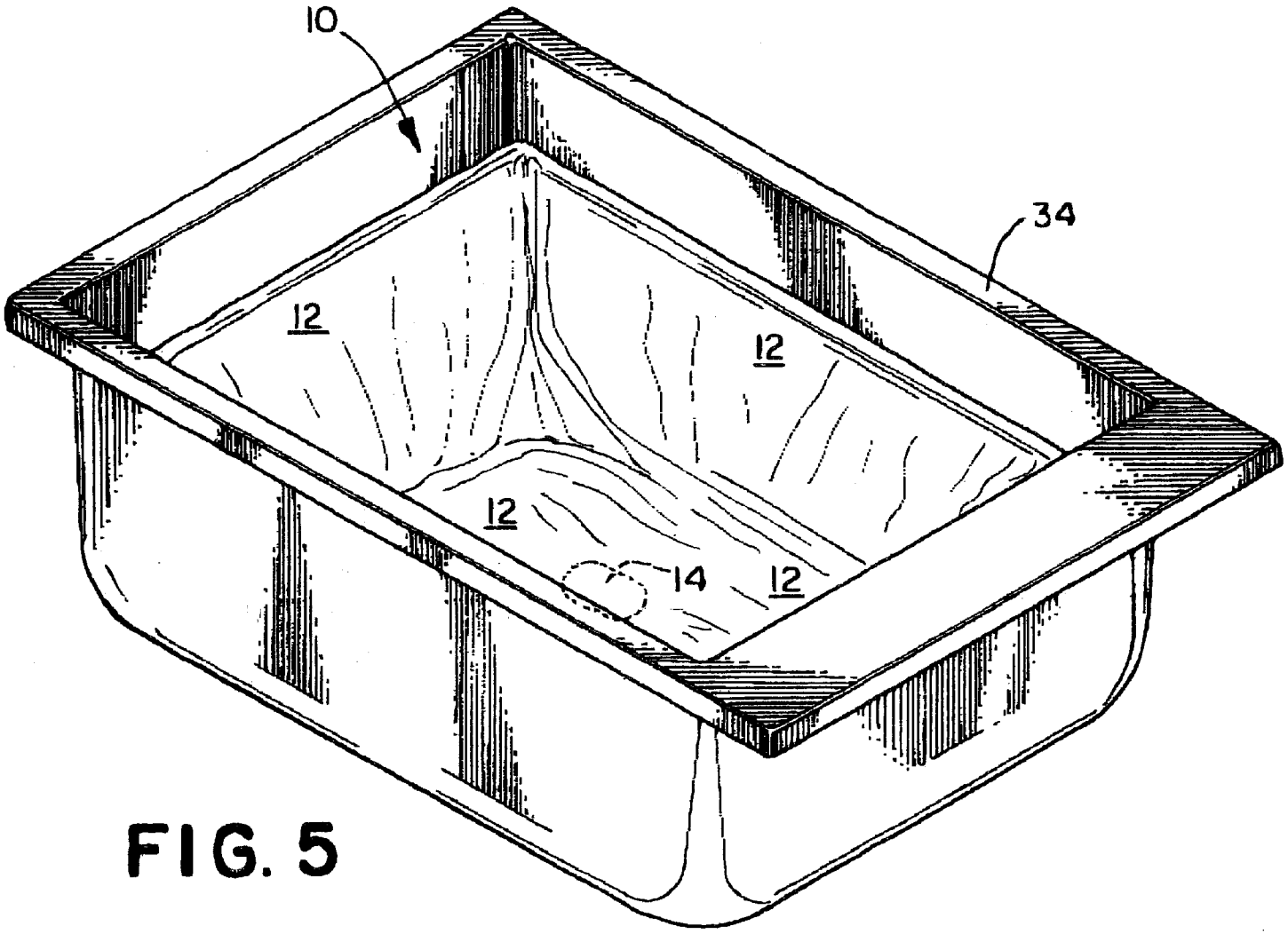
FIG. 5 is a perspective view of the drawer insert of FIG. 1 positioned in a crisper drawer.

Once the adjustable frame 16 is properly adjusted for length and width, and is positioned inside of a drawer-shaped container so that the frame members 18, 22, 26, 30 engage the sidewalls of the drawer, a liner 12, as shown in FIG. 4, is placed over the adjustable frame 16, as shown in FIG. 1. The liner 12 is positioned so that the edges of the liner 12 are disposed along the outward face of the adjustable frame 16 so that the liner 12 is effectively captured between the outer surfaces of the frame 16 and inner surfaces of the sidewalls of the drawer 34. Additionally, the liner 12 is pressed downwardly inside of the adjustable frame 16 to form a box shape that causes the sides of the liner 12 to be comparably shaped with the sides of the inner surface of the adjustable frame 16. Once the liner 12 is properly positioned about the adjustable frame 16, which is seated inside of a drawer-shaped container 34, the drawer insert 10 forms a protective insert for a drawer-shaped container, as shown in FIG. 5.

To allow the liner 12 to be properly positioned along the outer surface of the adjustable frame it is desirable to dimension the adjustable frame 16 so that a small gap, preferably about twice the thickness of the liner 12, exists between the sides of adjustable frame 16 and the inner surfaces of the drawer-shaped container. To aid in maintaining the proper placement of the liner 12 inside of the adjustable frame, a mild adhesive gum 14, such as that used in a Post-it® note, can be used to detachably secure the liner 12 to the supporting surface of the drawer-shaped container. While the preferred embodiment of the liner 12 uses only one mild adhesive gum 14, it should be understood from this disclosure by those of skill in the art that multiple mild adhesive gums 14 can be used to secure the liner 12 in its proper position.

To aid in the proper positioning of the liner 12 between the adjustable frame 16 and the crisper drawer 34, a pusher (not shown) may be used. The pusher may be a spatula-shaped device that simplifies the tucking of the liner 12 into the gap (not shown) between the adjustable frame 16 and the crisper 34.

While in the present embodiment of the drawer insert 10 the liner 12 is a thin disposable polymeric material, it should be understood from this disclosure by those of skill in the art that liners 12 having variable thicknesses may be used. For example, a more durable polymeric liner 12, similar to that used in an outdoor tarp, can be used with the drawer insert 10. Such a liner 12 would be capable of being cleaned and reused multiple times. Additionally, it is possible to incorporate a drawstring (not shown) into the liner 12 to allow a user to easily cinch up the sides of the liner 12 to facilitate disposal of debris contained therein.

Alternatively, it is possible to use a multi-layered liner 12 that is formed of many individual liners 12 that are each connected by a fairly weak, gummy material, similar to that used in Post-it® notes. In this manner, a user may remove one liner at a time without having to place a fresh liner between the adjustable frame 16 and the drawer-shaped container every time an individual liner 12 is removed for disposal. Accordingly, the drawer insert 10 may be designed to allow the user to consecutively remove individual liners 12 when debris makes it necessary. The use of multiple liners further increases the convenience of the drawer insert 10 in a variety of situations similar to those described above.

FIGS. 6–9 illustrate a second preferred embodiment of a drawer insert 110 in accordance with the present invention. Unlike the above-described drawer insert 10, the present drawer insert 110 is of a predetermined fixed size for being installed within a drawer of a similar predetermined size. In other words, the drawer insert 110 of the present embodiment is not adjustable in either the X or Y direction to accommodate drawers of differing sizes.

Figure 8:
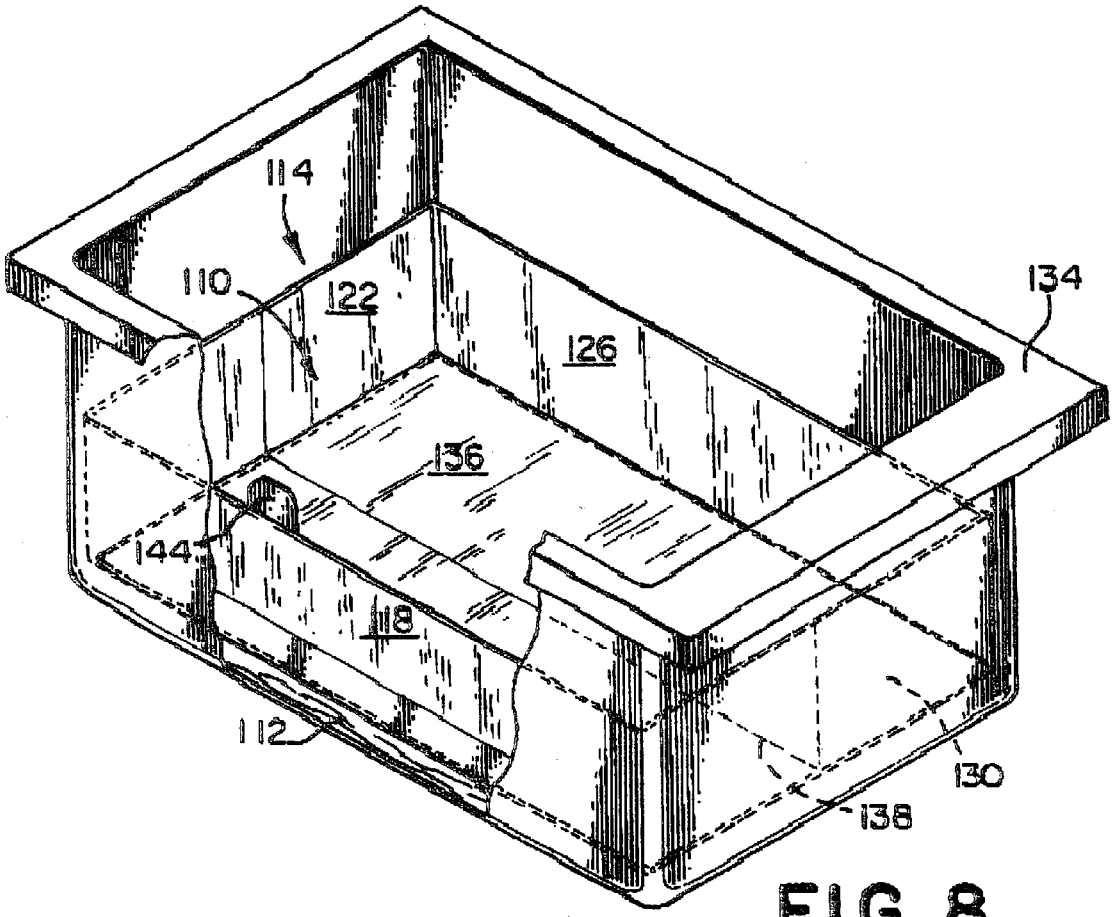
FIG. 8 is a perspective view of the drawer insert of FIG. 6 installed in a crisper drawer.

The drawer insert 110 includes a flexible liner 112 which is preferably in the form of a bag. The liner or bag 112 is secured to a generally continuous, generally tubular or frame 114. As with the above described embodiment, the frame 114 is formed a plurality, in the present embodiment four, interconnected, generally flat panels 118, 122, 126 and 130. It will be appreciated by those of ordinary skill in the art that the number of panels employed in the frame 114 corresponds to the number of sidewalls of the drawer within which the drawer insert 110 is to be installed. Each of the frame panels 118, 122, 126 and 130 is sized and shaped to substantially conform to the size and shape of the corresponding sidewall of a drawer 134 within which the insert 110 is to be installed (see FIG. 8). That is, and referring to FIG. 8, the first and third frame panels 118, 126 are substantially the same length as the lateral sidewalls of the drawer 134 and the second and fourth frame panels 122, 130 are substantially the same length as the front and rear sidewalls of the drawer 134. Preferably, each of the frame panels 118, 122, 126 and 130 has a height which is equal to or slightly less than the overall height of the sidewalls of the drawer 134. In this manner, when the frame 114 is installed within the drawer 134, the frame panels 118, 122, 126 and 130 tightly engage and cover at least a substantial portion of the interior surface of each of the corresponding sidewalls of the drawer 134 as illustrated in FIG. 8.

The frame panels 118, 122, 126 and 130 are made of a light weight material having a lateral stiffness sufficient so that the frame 114 is self-supporting when installed within a drawer 134. Preferably, the frame panels 118, 122, 126 and 130 are formed of a paper board or cardboard material which is sealed or coated with a suitable polymeric material so that the frame panels 118, 122, 126 and 130 are substantially moisture-proof. Alternatively, the frame panels 118, 122, 126 and 130 may be made of some other suitable light weight, generally stiff material such as a polymeric material, metal, or the like. The only requirements are that the frame panels 118, 122, 126 and 130 be light weight and generally self-supporting.

Figure 9:
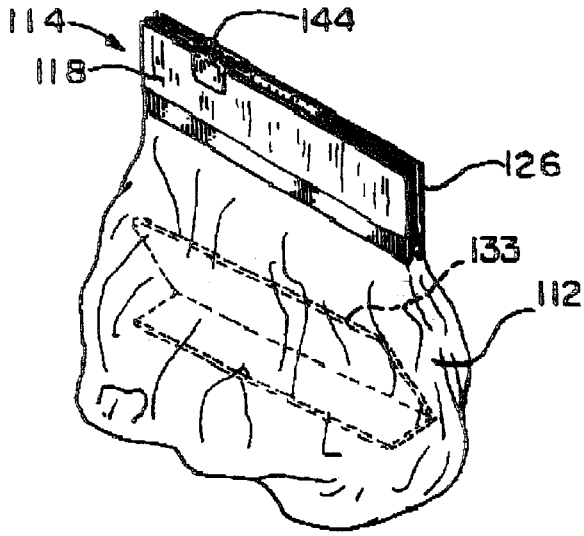
FIG. 9 is a perspective view of the draw insert of FIG. 6 prior to disposal.

The frame 114 may be formed of four individual panels 118, 122, 126 and 130 which are joined or hinged together along their respective abutting ends as shown in FIG. 7 to form a generally continuous frame 114. Alternatively, the frame 114 may be formed of a generally continuous single length of material which is scored, bent or otherwise deformed at predetermined locations along its length to permit the strip of material to be bent to thereby form the frame panels 118, 122, 126 and 130. Preferably, a weakened area or score line is formed approximately half way along the length of each of the second and fourth frame panels 122, 130 to permit the second and fourth frame panels 122, 130 to be bent in half as illustrated in FIG. 7. Bending the second and fourth frame panels 122, 130 in half, inwardly as shown permits the frame 114 to be collapsed to a generally flat condition as shown in FIG. 9. In this manner, the frame 114 can be conveniently packaged in a much smaller space for shipment and storage prior to use and, after use, can take up a much smaller space for disposal.

The bag 112 is secured to and extends from the lower end of the frame 114 as shown in FIGS. 7 and 9. In the present embodiment, the bag 112 is preferably made of a polymeric material of a type well known in the trash bag art. Any other suitable material may alternatively be employed for the bag 112. In the present embodiment, the circumference of the opening or mouth of the bag 112 is sized to correspond to the perimeter of the frame 114. In this manner, the mouth of the bag 112 can be conveniently secured to the frame 114 as shown so that the frame 114 effectively keeps open the mouth of the bag 112. In the illustrated embodiment, the bag 112 is secured to the lower end of the outer surface of the frame 114 utilizing adhesive, tape, sonic welding, or any other suitable method of attachment. Alternatively, the bag 112 may be secured to the interior surface of the frame 114 or may be secured to the frame 114 in some other manner. However, the bag 112 must be secured to the frame 114 so that when the drawer insert 110, is removed from the drawer 134, the bag 112 and frame 114 are secured together with the frame 114 supporting the bag 112 and, when collapsed, forming a closure for the bag 112 as shown in FIG. 9.

As shown in FIG. 7, the drawer insert 110 further includes a cover panel 136. The cover panel 136 has a length which generally corresponds to but is slightly smaller than the length of the first and third frame panels 118, 126 and a width which generally corresponds to but is slightly smaller than the length of the second and fourth frame panels 122, 130. In this manner, the cover panel 136 is sized to fit tightly within the frame 114 as shown in FIG. 8 to thereby help maintain the shape of the frame 114 and to also help keep the frame panels 118, 122, 126 and 130 in tight engagement with the sidewalls of the drawer 134 when the drawer insert 110 is installed therein. The cover panel 136 also effectively covers the bag 112 to enhance the appearance of the drawer insert 110 when installed within the drawer 134.

Preferably, the cover panel 136 is made of the same material as the frame panels 118, 122, 126 and 130 and preferably is the same color in order to provide an enhanced appearance. If desired, the cover panel 136 may be made of a different, light weight, generally stiff material. As shown in FIG. 7, the cover panel 136 includes a weakened or scored line 138 extending longitudinally along the entire length thereof to permit the cover panel 136 to fold laterally in half. Alternatively, the cover panel 136 may be formed of two separate panels which are hinged together. In either event, the cover panel 136 is adapted to be folded laterally in half in order to make the cover panel 136 smaller for shipping, storage and handling.

FIG. 6 illustrates the drawer insert 110 as it is initially packaged. The drawer insert 110 is packaged by tucking the bag 112 within the interior of the frame 114 and then folding the frame 114 by moving the first and third frame panels 118, 126 toward each other so that the second and fourth frame member panels 122, 130 fold inwardly as shown in FIG. 7. Once the frame 114 is folded flat (see FIG. 9) with the bag 112 tucked therein, the frame 114 is placed between the folded halves of the cover panel 136 to effectively retain the frame 114 therein. A tab member 140 on one side of the cover panel 136 is employed for securing together the two sides of the cover panel 136 as shown in FIG. 6. Preferably, the tab member 140 includes a suitable adhesive 142 or some other suitable material for holding together the two halves of the cover panel 136 during shipment, storage, etc. It will be appreciated by those of ordinary skill in the art that some other method may be employed for securing together the two halves of the cover panel 136. For example, the cover panel 136 may be encased within a clear polyurethane material or a clip or sleeve-like member may be installed on the folded cover panel 136.

To use the drawer insert 110, a user first tears or otherwise removes the tab member 140 to permit the cover panel 136 to open for removal of the frame 114 and bag 112. The frame panels 118, 122, 126 and 130 are then expanded outwardly and the frame 114 is installed within a drawer 134 with the bag 112 engaging the bottom side of the drawer so that the bag 112 is effectively positioned between the frame panels 118, 122, 126 and 130 as shown in FIG. 8. The cover member 136 is then fully opened and placed in the drawer 134 between the frame panels 118, 122, 126 and 130 as shown in FIG. 8. In this manner, the cover panel 136 maintains the frame panels 118, 122, 126 and 130 in firm engagement with the sidewalls of the drawer 134 and also effectively covers the bag 112 to provide an enhanced appearance. With the drawer insert 110 installed in place as shown in FIG. 8, the drawer 134, which in the present embodiment is a refrigerator crisper drawer, may then be used in the usual manner.

After a period of use, spoiled or rotten fruits or vegetables, skins, stems or the like which fall off of fruits or vegetables or liquids which are secreted by fruits or vegetables are accumulated within the drawer insert 110. The drawer insert 110 protects the bottom wall as well as at least a portion of the sidewalls of the drawer 134 to keep the drawer 134 substantially free of any such debris. When it is desired to remove the debris, the frame 114 is lifted upwardly along the sidewalls of the drawer 134 so that the cover panel 136 and all of the debris is captured within the bag 112 which expands as needed. The frame 114 is then collapsed by moving the first and third frame panels 118, 126 toward each other so that the second and fourth frame panels 122, 130 collapse inwardly. Collapsing the frame 114 in this manner effectively closes and seals the bag 112 as shown in FIG. 9. A closure member, in this embodiment a second tab member 144 is located on the upper end of the first frame panel 118. Preferably the second tab member 144 includes a suitable adhesive on the inner surface thereof so that when the frame 114 is collapsed to close the bag 112 as shown in FIG. 9, the tab 144 can be bent over to engage the outer surface of the third frame panel 126 to effectively retain the frame 114 in the collapsed condition as shown in FIG. 9 to thereby maintain the bag 112 in a closed condition. Alternatively, the cover panel 136 maybe removed and retained for further use or may be disposed of in some other manner. The entire drawer insert 110 may then be disposed of and a new drawer insert 110 may be installed within the drawer 134 as described above. In this manner, the sidewalls and bottom wall of the drawer 134 are continuously maintained in a clean condition without the need to scrape, scrub or otherwise deal with any build up of debris or materials within the bottom of the drawer 134. If desired, drawer inserts 110 of differing sizes may be made to accommodate drawers 134 of different sizes. If desired, the bag 112 may be smaller (i.e. not as deep) or larger (the deeper) as the bag as illustrated in FIG. 7. In addition, the drawer insert 110 may be employed without the cover panel 136 if desired.

It will be appreciated by those skilled in the art that changes could be made to the embodiments described above without departing from the broad inventive concepts thereof. It is understood, therefore, that the drawer insert is not limited to the particular embodiments disclosed, but it is intended to cover modifications within the spirit and scope of the present invention as set forth in the claims.

What is claimed is:

1. A protective insert for a drawer having four sidewalls which are inter-connected by a bottom wall, the insert comprising:

a generally continuous generally tubular frame formed of four orthagonally connected generally flat panels with two opposing panels being foldable to permit the frame to collapse for shipping and storage, each of the frame panels being sized and shaped to conform to and to engage and cover at least a portion of an interior surface of a corresponding one of the sidewalls of the drawer;

a flexible liner extending between each of the panels of the frame to engage and cover at least a substantial portion of the bottom wall of the drawer, whereby the frame retains the liner in place within the drawer such that the combination of the liner and the frame cover and protect at least a substantial portion of the interior surface of the drawer; and a closure member to bold the frame in a collapsed condition for disposal.

2. The protective insert as recited in claim 1 wherein the closure member comprising a tab on one panel of the frame, the tab including adhesive for securing the tab to an opposing frame panel when the frame is collapsed.

3. A protective insert for a drawer having four sidewalls which are inter-connected by a bottom wall, the insert comprising:

a generally continuous generally tubular frame formed of four orthagonally connected generally flat panels with two opposing panels being foldable to permit the frame to collapse for shipping and storage, each of the frame panels being sized and shaped to conform to and to engage and cover at least a portion of an interior surface of a corresponding one of the sidewalls of the drawer;

a flexible liner extending between each of the panels of the frame to engage and cover at least a substantial portion of the bottom wall of the drawer, whereby the frame retains the liner in place within the drawer such that the combination of the liner and the frame cover and protect at least a substantial portion of the interior surface of the drawer; and a cover panel sized to fit within the frame to hold the frame in an open condition and in engagement with the sidewalls of the drawer, the cover panel being foldable to form a package for the frame and liner.

4. A protective insert for a refrigerator drawer having four sidewalls which are inter-connected by a bottom wall the insert comprising:

a generally continuous generally tubular frame formed of four orthagonally connected generally flat panels, the panels being foldable to permit the frame to collapse for shipping and storage, each of the frame panels being sized and shaped to conform to and to engage and cover at least a portion of an interior surface of a corresponding one of the sidewalls of the refrigerator drawer;

a flexible liner extending between each of the panels of the frame to engage and cover at least a substantial portion of the bottom wall of the refrigerator drawer, whereby the frame retains the liner in place within the refrigerator drawer such that the combination of the liner and the frame cover and protect at least a substantial portion of the interior surface of the refrigerator drawer; and a cover panel sized to fit within the frame to hold the frame in an open condition and in engagement with the sidewalls of the refrigerator drawer, the cover panel being foldable to form a package for the frame and liner.

* * * * *